US007976356B2

(12) United States Patent
Bruder

(10) Patent No.: US 7,976,356 B2
(45) Date of Patent: Jul. 12, 2011

(54) TOY VEHICLE

(75) Inventor: Paul Heinz Bruder, Fürth (DE)

(73) Assignee: Bruder Spielwaren GmbH & Co. KG, Fürth (DE)

( * ) Notice: Subject to any disclaimer, the term of this patent is extended or adjusted under 35 U.S.C. 154(b) by 435 days.

(21) Appl. No.: 12/172,246

(22) Filed: Jul. 13, 2008

(65) Prior Publication Data

US 2009/0233520 A1 Sep. 17, 2009

(30) Foreign Application Priority Data

Mar. 15, 2008 (DE) ..... 20 2008 003 709 U

(51) Int. Cl.
*A63H 17/05* (2006.01)

(52) U.S. Cl. ..... 446/434; 446/426; 446/427; 446/428; 446/431; 446/465

(58) Field of Classification Search ..... 446/426–428, 446/431, 434, 465
See application file for complete search history.

(56) References Cited

U.S. PATENT DOCUMENTS 2,681,739 A * 6/1954 Gokey ..... 414/546
2,705,388 A * 4/1955 Gokey ..... 446/428
2,954,092 A * 9/1960 Thornton-Trump ..... 182/2.1
2,998,861 A * 9/1961 Hotchkiss ..... 182/2.3
3,308,573 A * 3/1967 Ryan ..... 446/411
3,392,484 A * 7/1968 Ryan et al. ..... 446/409
3,472,401 A * 10/1969 Scaperotto ..... 414/734
3,521,781 A * 7/1970 Holsinger et al. ..... 414/701
4,383,793 A * 5/1983 Weir ..... 414/686
4,435,916 A * 3/1984 Iwao et al. ..... 446/470
4,516,952 A * 5/1985 Brand et al. ..... 446/427
4,552,274 A * 11/1985 Lundin ..... 212/232
4,712,968 A * 12/1987 Manning ..... 414/694
4,854,811 A * 8/1989 Veys ..... 414/718
4,999,022 A * 3/1991 Veys ..... 414/718
5,435,768 A * 7/1995 Dunleavy ..... 446/427
5,526,591 A * 6/1996 Otwell ..... 37/444
5,572,908 A * 11/1996 Bruder ..... 74/577 R
5,584,743 A * 12/1996 Beaulieu ..... 446/427
5,676,585 A * 10/1997 Nuermberger et al. ..... 446/428
5,846,120 A * 12/1998 Barton, Jr. ..... 446/434
5,868,218 A * 2/1999 Lawson ..... 182/69.6
5,879,221 A * 3/1999 Barton et al. ..... 446/427

(Continued)

*Primary Examiner* — Gene Kim
*Assistant Examiner* — Alexander R Niconovich
(74) *Attorney, Agent, or Firm* — Browdy and Neimark, PLLC

(57) ABSTRACT

A boom assembly for a bucket of a toy vehicle comprises at least one bucket bearer, which is articulated to a frame of the toy vehicle by a first swivel joint, and at least one telescopic support with two telescopic elements, which can be displaced in telescopic manner with respect to one another. One of the telescopic elements is articulated to the bucket bearer by a second swivel joint, the other telescopic element is articulated to the frame by a third swivel joint. Furthermore, at least one latch mechanism is provided, the latch mechanism having a latch body which is provided on one of the telescopic elements, and a counter body which is provided on the bucket bearer. The bodies of the latch mechanism are positioned with respect to one another such that when the bucket bearers are moved from a lowered basic position into a raised position, the latch body comes to rest against the counter body before the raised position is reached, the telescopic support being bent with the production of a bending tension. As the bucket bearers are moved further into the raised position, the latch body latches with the counter body so that the boom assembly is fixed in the raised position.

9 Claims, 8 Drawing Sheets

U.S. PATENT DOCUMENTS

| | | | | |
|---|---|---|---|---|
| 5,989,096 | A * | 11/1999 | Barton et al. | 446/425 |
| 6,165,044 | A * | 12/2000 | Lamar, Jr. | 446/427 |
| 6,264,528 | B1 * | 7/2001 | Doan et al. | 446/424 |
| 6,485,351 | B2 * | 11/2002 | Bruder | 446/427 |
| 7,008,291 | B2 * | 3/2006 | Bruder | 446/460 |
| 7,044,826 | B2 * | 5/2006 | Edwards | 446/428 |
| 7,347,763 | B2 * | 3/2008 | Ewringmann | 446/427 |
| 7,601,047 | B2 * | 10/2009 | Bruder | 446/424 |
| 7,762,867 | B2 * | 7/2010 | Agostini et al. | 446/431 |
| 2006/0178084 | A1 * | 8/2006 | Bruder | 446/428 |
| 2008/0207086 | A1 * | 8/2008 | Ewringmann | 446/428 |
| 2009/0014251 | A1 * | 1/2009 | McCracken | 187/272 |

* cited by examiner

TOY VEHICLE

BACKGROUND OF THE INVENTION

1. Field of the Invention

The invention relates to a toy vehicle, in particular to a toy digger, with a bucket which can be changed between a basic position and a raised position, in particular a digger bucket.

2. Background of the Invention

Toy vehicles are articles of play equipment well loved by children. A good play experience is guaranteed by a toy vehicle if the bucket thereof can be operated in as realistic a manner as possible, thus in a manner comparable to that of the real model.

SUMMARY OF THE INVENTION

It is therefore an object of the present invention to develop a toy vehicle of the type mentioned at the outset such that a realistic change of positions is ensured at a justifiable expense in terms of construction.

This object is achieved according to the invention by a toy vehicle with a boom assembly for a bucket, wherein the boom assembly comprises at least one bucket bearer which is articulated to a frame of the toy vehicle by a first swivel joint and at least one telescopic support with two telescopic elements which can be displaced in telescopic manner with respect to one another, one of the telescopic elements being articulated to the bucket bearer by a second swivel joint and the other telescopic element being articulated to the frame by a third swivel joint; wherein at least one latch mechanism is provided, the latch mechanism having a latch body which is provided on one of the telescopic elements and a counter body which is provided on the bucket bearer; wherein the bodies of the latch mechanism are positioned with respect to one another such that when the bucket bearers are moved from a lowered basic position into a raised position, the latch body comes to rest against the counter body before the raised position is reached, the telescopic support being bent with the production of a bending tension, and as the bucket bearers are moved further into the raised position, the latch body latches with the counter body so that the boom assembly is fixed in the raised position.

The use of the at least one bucket bearer and the at least one telescopic support ensures a sequence of movements of mechanical components which corresponds to the real model when the bucket is changed from the basic position into the raised position. The latch mechanism guarantees, at a constructionally low cost, that after the change-over into the raised position, the at least one bucket bearer remains in this position. Therefore, the bucket does not have to be continuously supported by hand in the raised position. It is possible to produce the latch mechanism at a constructionally low cost, since the at least one telescopic support which is present anyway is used as the pretensioning element.

An unlatching lever with an impact body which can be changed over between a rest position in which the impact body is at a distance from the telescopic support and an unlatching position in which the impact body exerts pressure on the telescopic support such that the latch body is released from the counter body, as the telescopic support is bent, for unlatching the raised position of the boom assembly ensures that the bucket readily changes from the raised position back into the basic position as the securing latch mechanism is overcome.

An embodiment of a toy vehicle wherein the telescopic support and the bucket bearer are made of plastics material, the latch body and/or the counter body in particular being integrally formed parts of these components, can be realized in an economic manner. Individual components or all components of the toy vehicle can be configured as injection molded components, for example. In particular, the telescopic rod of the telescopic support can be produced from plastics material. Other components of the toy vehicle, in particular the bucket bearers or parts of the latch mechanism can also be produced from metal.

An embodiment of the at least one unlatching lever which is articulated to the bucket bearer is simple to construct. Since the bucket bearers are routinely configured to be relatively long, the unlatching lever can also be configured to be long, thus having an effective lever action.

An arrangement of the latch body in the central region of the fully extended telescopic support ensures that the telescopic support is bent or deflected at the point of its greatest resilience in order to produce a latching pretension.

An embodiment wherein the boom assembly has pairs in each case of bucket bearers, telescopic supports and latch mechanisms closely approximates the real model. Two latch mechanisms ensure that the bucket bearers are secured symmetrically in the raised position.

A pair of unlatching levers of the boom assembly is adapted to and associated with the embodiment of a pair of latch mechanisms.

A common actuating element for actuating the unlatching levers allows a simple simultaneous unlatching of both latch mechanisms. Alternatively, two separate actuating elements can also be provided.

An embodiment of the invention is described in detail in the following with reference to the drawings.

DESCRIPTION OF THE PREFERRED EMBODIMENTS

A boom assembly 1 for a bucket 2 is a component of a toy vehicle in the form of a digger loader. All of the boom assembly 1 is made of plastics material, as is the bucket 2. The boom assembly 1 can also be mounted on another type of toy vehicle instead of a digger, for example a front-end loader.

Figure 3:
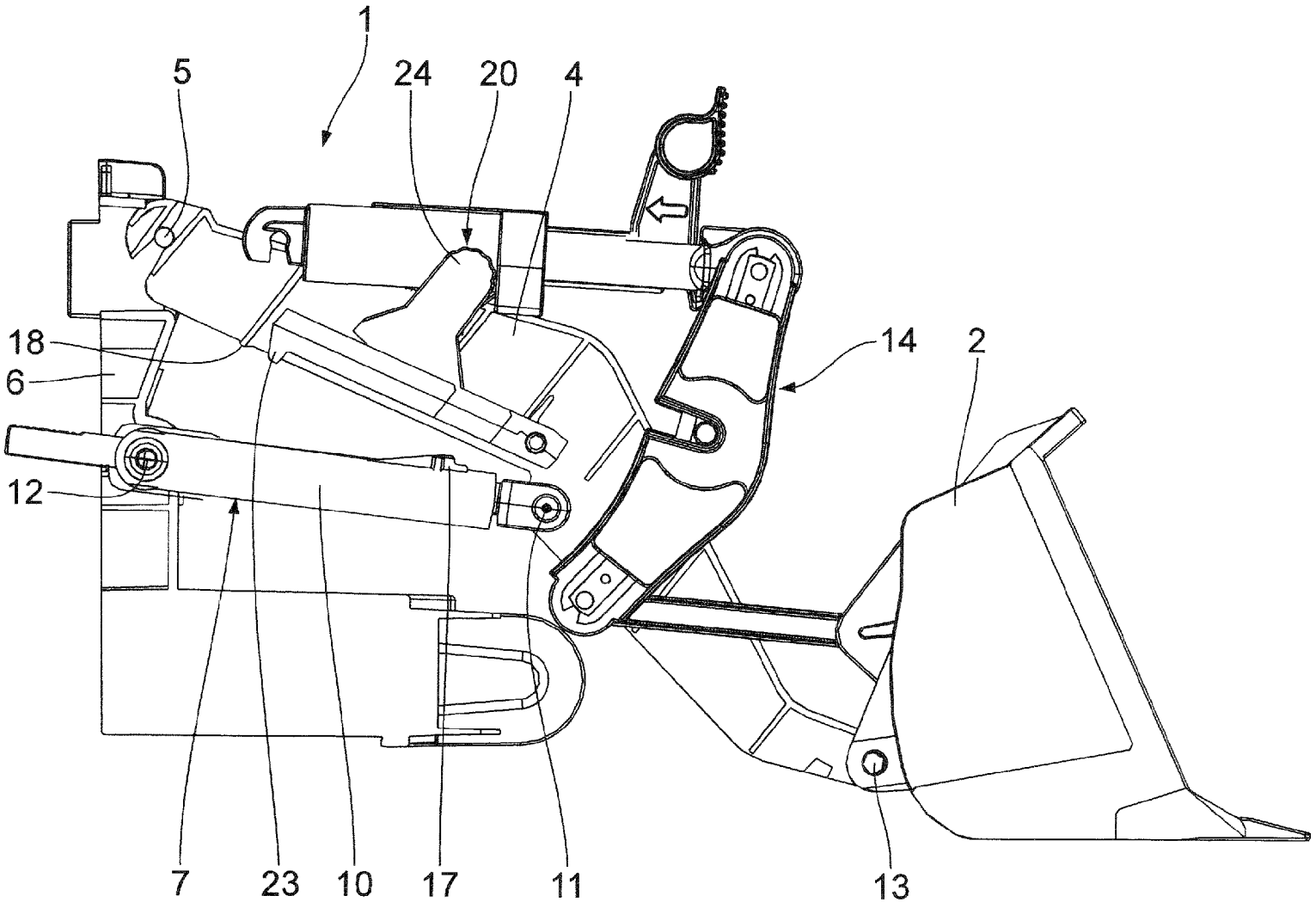
FIG. 3 is a side view of the boom assembly in the basic position where a bucket bearer facing the observer, a telescopic support facing the observer and a few other components on the side of the observer of the boom assembly have been omitted.
Figure 4:
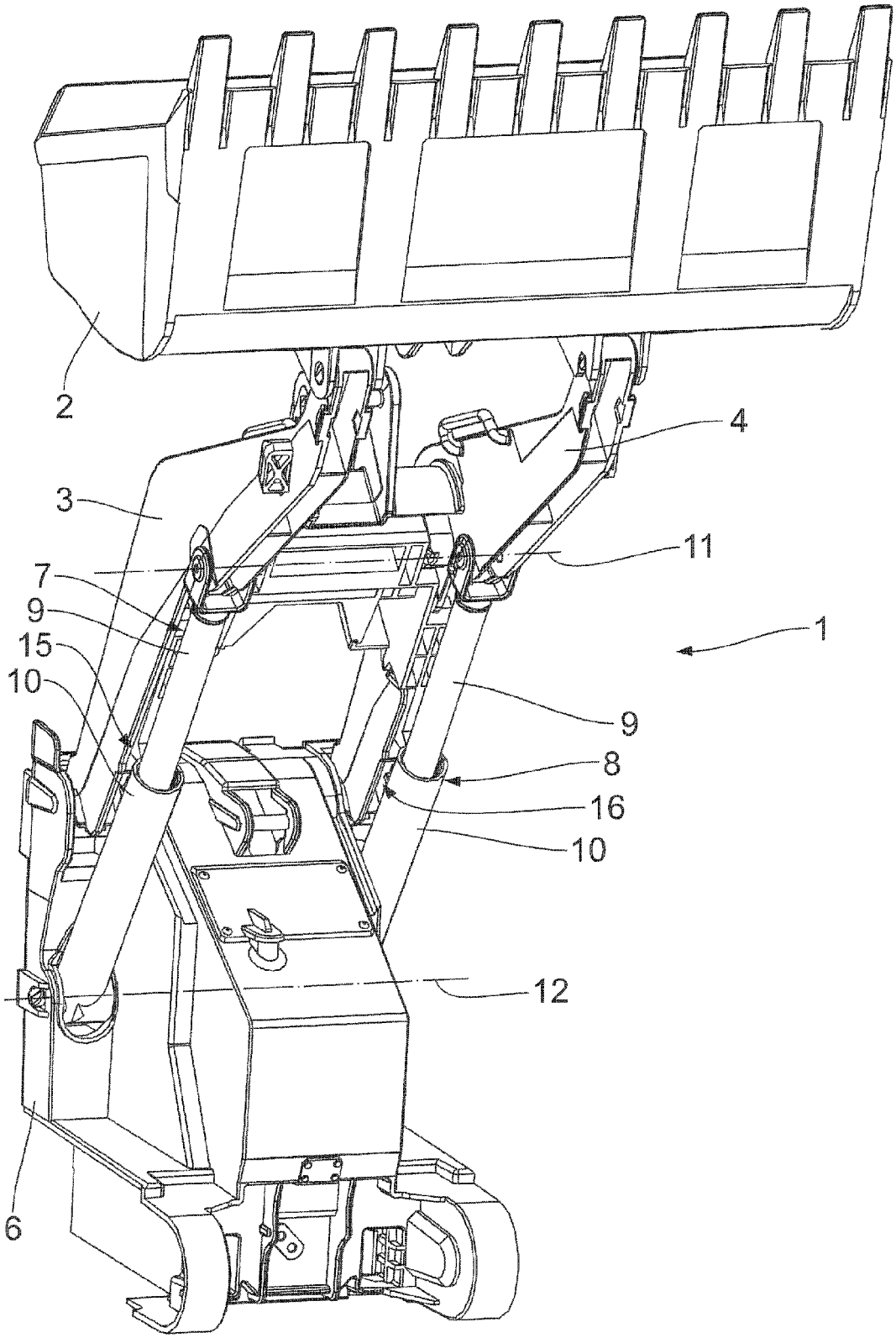
FIG. 4 is a perspective view of the boom assembly in an upper raised position of the bucket.
Figure 5:
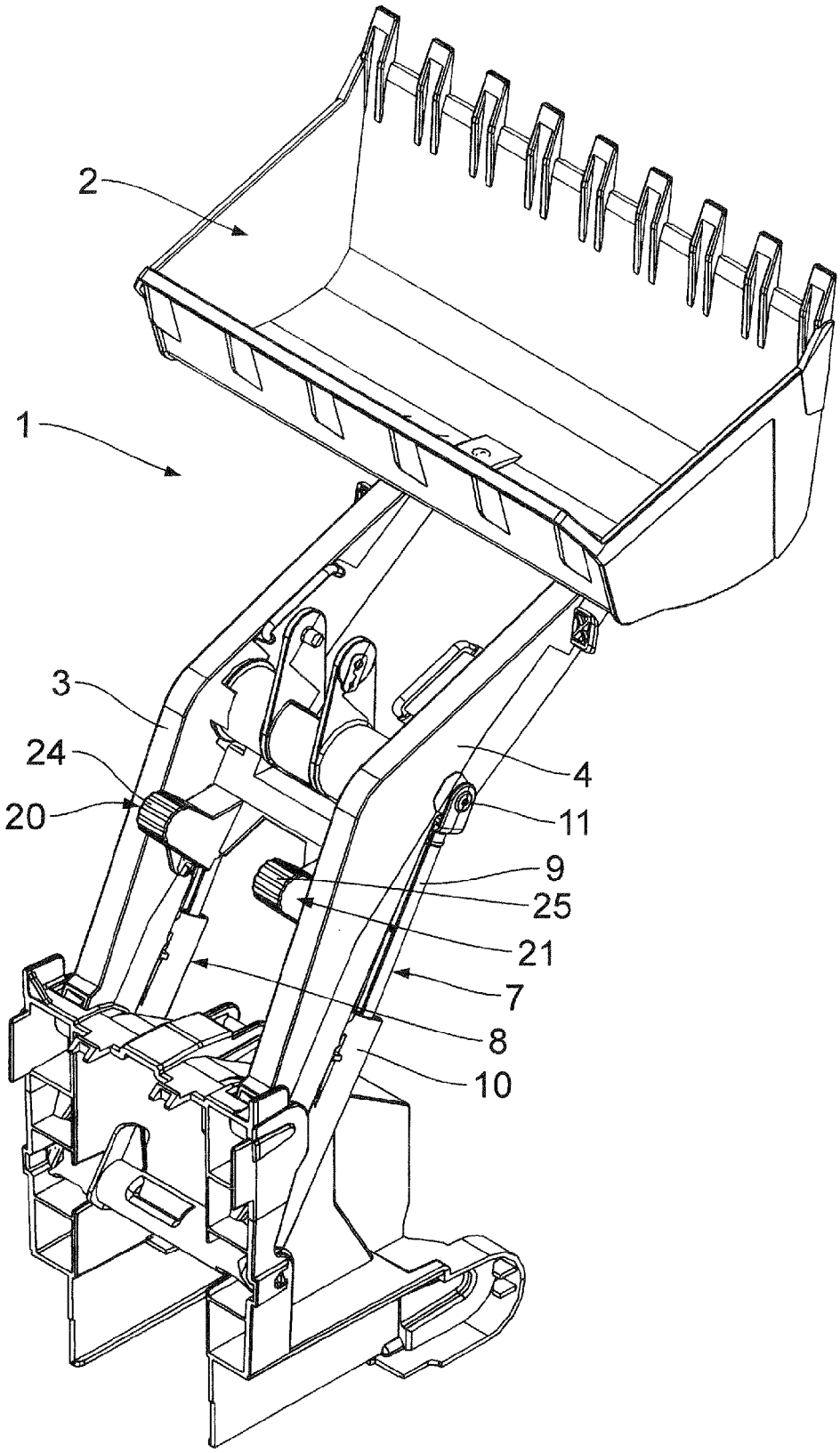
FIG. 5 is a perspective view of the boom assembly with the bucket in the upper raised position from another viewing direction.

The boom assembly 1 has two bucket bearers 3, 4 which are articulated in each case to a frame 6 of the toy vehicle by a first swivel joint with a swivel pin 5 (cf. FIG. 3). Furthermore, the boom assembly 1 has two telescopic supports 7, 8. Each of the two telescopic supports 7, 8 has two telescopic elements 9, 10 which can be displaced telescopically with respect to one another, namely a telescopic rod 9 and a telescopic sleeve 10 which guides the telescopic rod 9 in a telescopic manner.

The telescopic rods 9 of the two telescopic supports 7, 8 are articulated to the two bucket bearers 3, 4 by two second swivel joints with a swivel pin 11. The telescopic sleeves 10 of the two telescopic supports 7, 8 are articulated to the frame 6 by two third swivel joints with a swivel pin 12.

Figure 1:
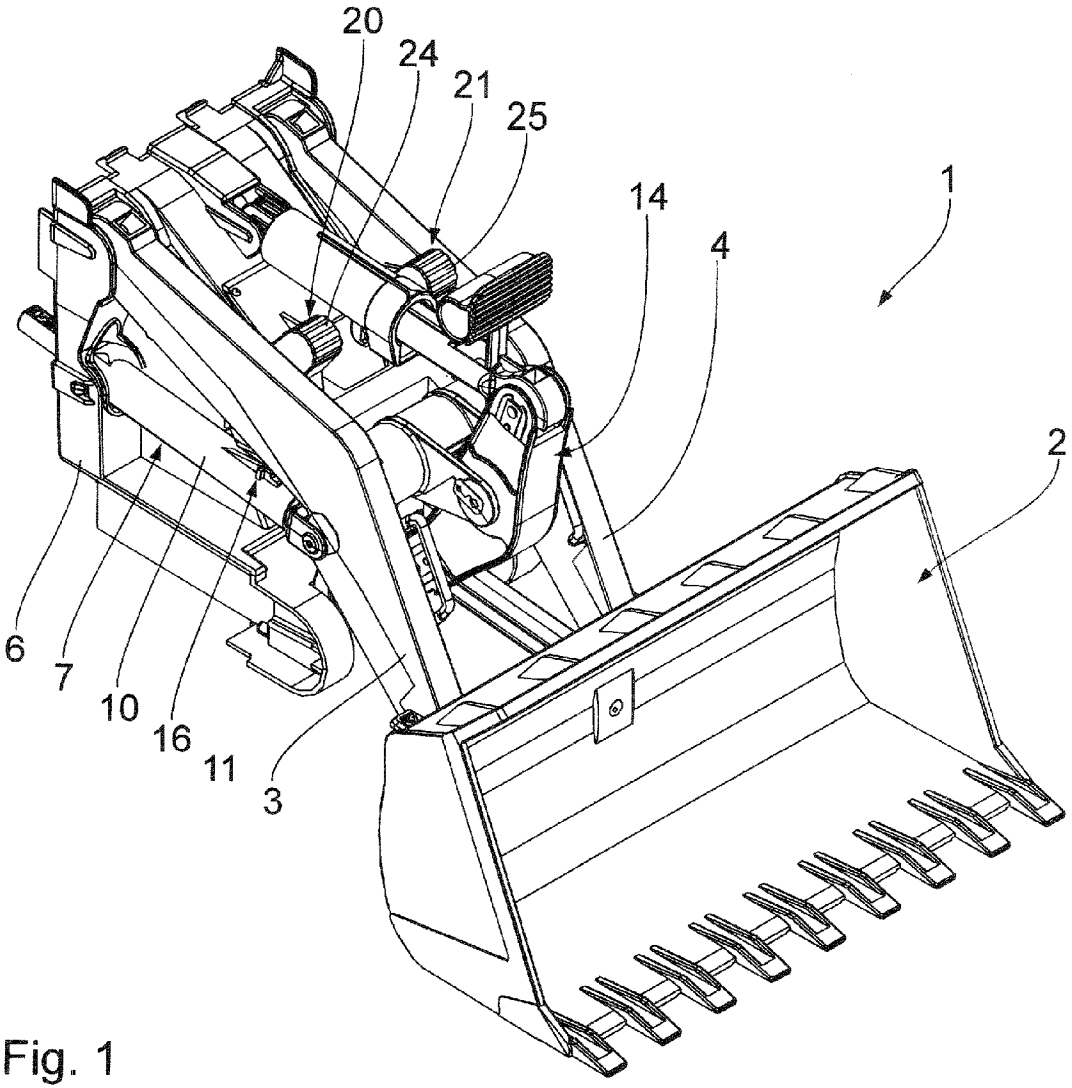
FIG. 1 is a perspective view of a boom assembly for a bucket of a toy vehicle in a basic position.
Figure 2:
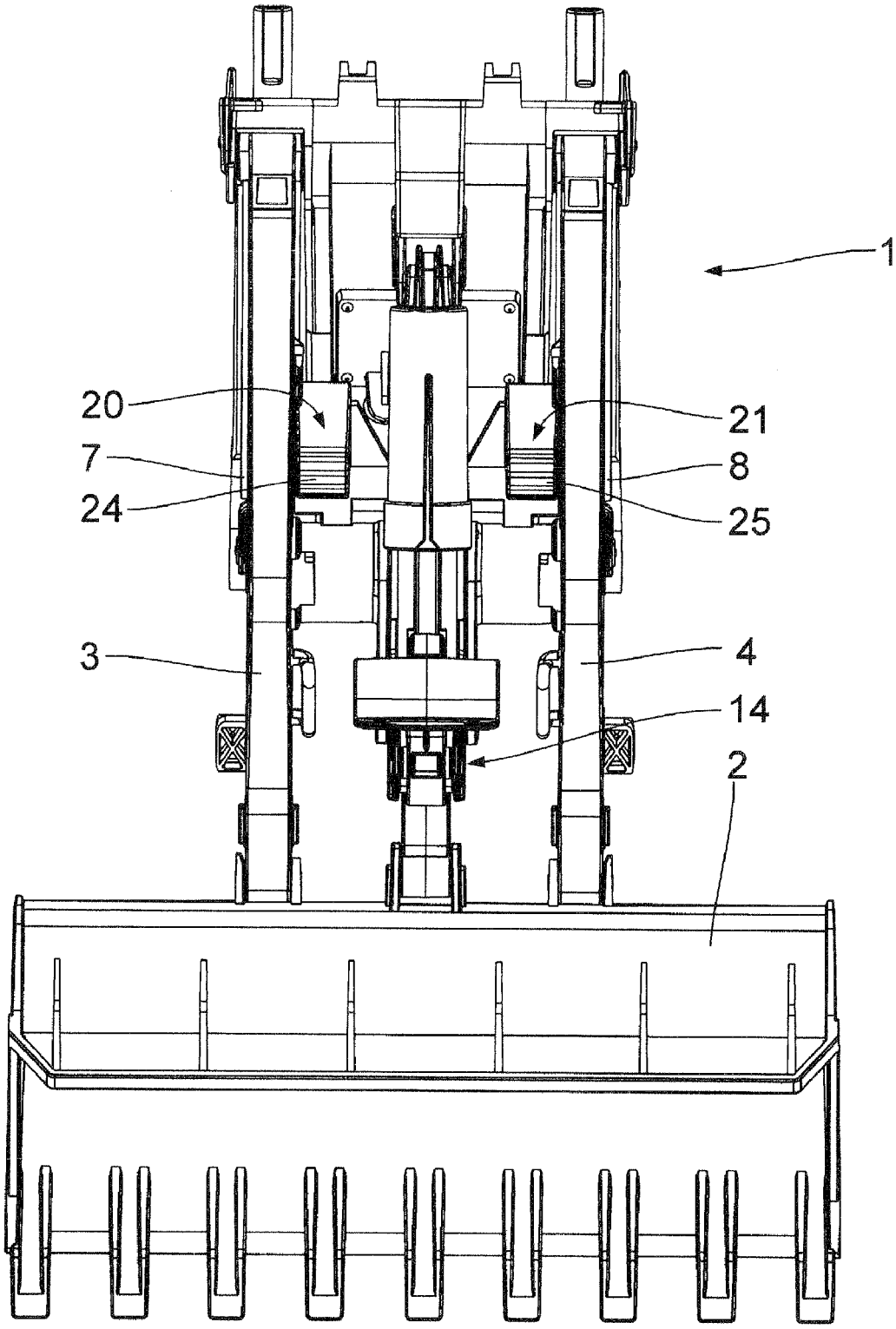
FIG. 2 is a plan view of the boom assembly in the basic position.

The three swivel pins 5, 11 and 12 extend horizontally parallel to one another. The swivel pin 12 is located under the swivel pin 5. In a basic position of the boom assembly which is shown in FIGS. 1 to 3 and in which the bucket 2 has been lowered, for example for flattening the ground or for excavating earth, the swivel pin 11 is located upstream of the swivel pin 12 in the direction of travel of the toy vehicle.

In the basic position, the piercing points of the three swivel pins 5, 11 and 12 approximately form a right-angled triangle, the right angle being located at the corner, formed by the swivel pin 12, of the triangle. The leg, formed between the swivel pins 11, 12, of this right-angled triangle is approximately double the length of the leg formed between the swivel pins 5 and 12 in the basic position.

The bucket 2 is articulated to the bucket bearers 3, 4 by a further swivel joint with a horizontal swivel pin 13. A pivoting angle of the bucket 2 about the swivel pin 13 relative to the bucket bearers 3, 4 can be preset by a lever assembly 14.

Two similarly constructed latch mechanisms 15, 16 also belong to the boom assembly 1. The latch mechanisms 15, 16 have in each case a latch body 17 which is positioned on the telescopic sleeves 10 of the telescopic supports 7, 8, and a counter body 18 which is positioned on the bucket bearers 3, 4. As shown, for example in FIG. 7, the latch body 17 is positioned in the region of the center of the completely extended telescopic supports 7, 8. The bucket bearers 3, 4 each have a reinforcing rib 19 in the region of the counter bodies 18.

The latch body 17 is a plastics material component in each case formed integrally with the respective telescopic sleeve 10. The counter body 18 is a plastics material component formed integrally with the respective bucket bearer 3, 4.

Two unlatching levers 20, 21 which are articulated in each case to one of the bucket bearers 3, 4 by a swivel joint with a swivel pin 22 also belong to the boom assembly 1.

At their free ends, the unlatching levers 20, 21 have an impact body 23 configured in the manner of a hammer head. By actuating the unlatching levers 20, 21 by means of a pair of common actuating elements 24, 25, the impact body 23 can be changed over between a rest position in which the impact bodies 23 are at a distance from the telescopic supports 7, 8 and an unlatching position. In the unlatching position, the impact bodies 23 rest against the telescopic supports 7, 8 and deflect them.

Figure 6:
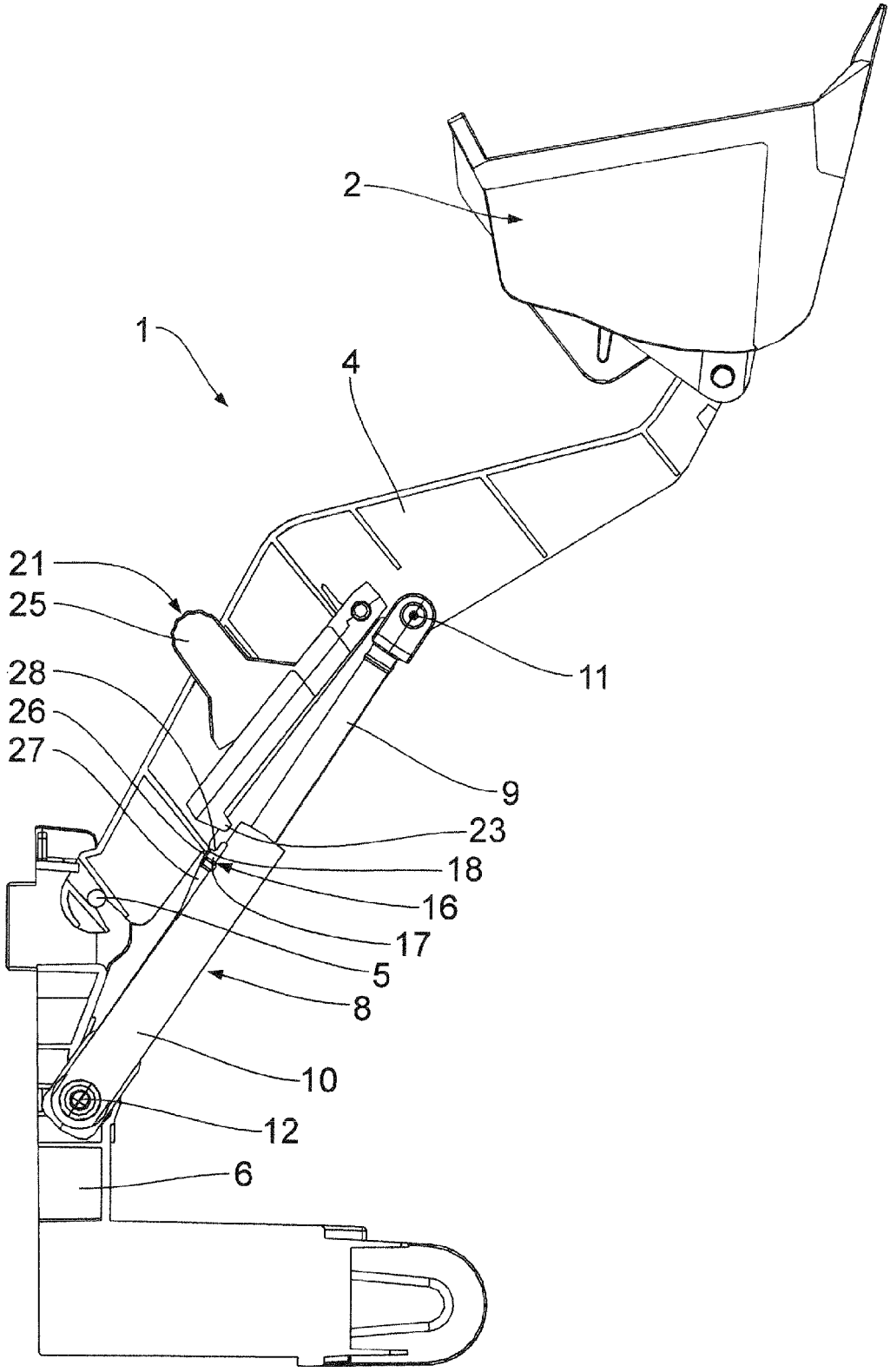
FIG. 6 is a view similar to that of FIG. 3 of the boom assembly shortly before reaching the upper raised position, further observer-side components having been omitted.
Figure 7:
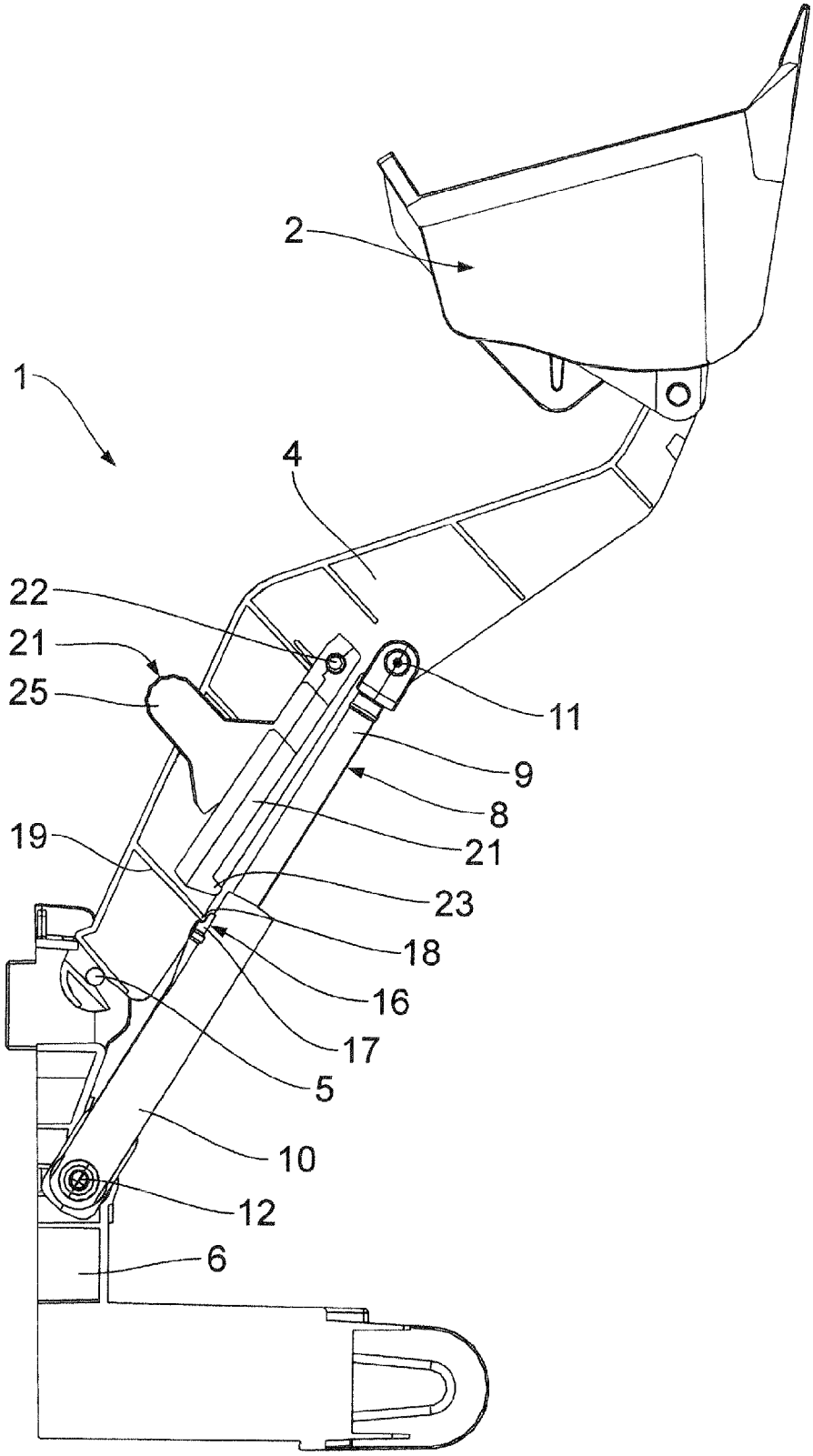
FIG. 7 is a view similar to that of FIG. 6 of the boom assembly in the upper raised position.

When the bucket bearers 3, 4 are moved from the lowered basic position into an upper raised position according to FIG. 7, an intermediate position is initially reached according to FIG. 6. In this intermediate position, the counter bodies 18 rest against a projecting nose of the latch body 17. Before reaching the intermediate position according to FIG. 6, the counter bodies 18 have already slid along ramps 27 of the latch bodies 17, the telescopic supports 7, 8 being increasingly bent by the bucket bearers 3, 4. In the intermediate position according to FIG. 6, this deflection of the telescopic supports 7, 8 is at a maximum, such that a maximum spring tension has built up in the telescopic supports 7, 8. If the two bucket bearers 3, 4 are moved from the intermediate position according to FIG. 6 slightly further in the direction of the upper raised position, the counter bodies 18 latch into a latch seat 28 in the latch body 17 so that the upper raised position according to FIG. 7 is reached. The bucket bearers 3, 4 are then fixed in this raised position by the latch mechanisms 15, 16 so that it is possible to let go of the bucket bearers 3, 4 without the bucket bearers 3, 4 returning into the basic position by virtue of their own weight.

In the raised position, the distance between the swivel pins 11, 12 is approximately doubled. The length of the telescopic supports 7, 8 has also doubled accordingly. The other two side lengths of the triangle formed by the swivel pins 5, 11 and 12 have not changed, since there are no longitudinally variable components effective here.

Figure 8:
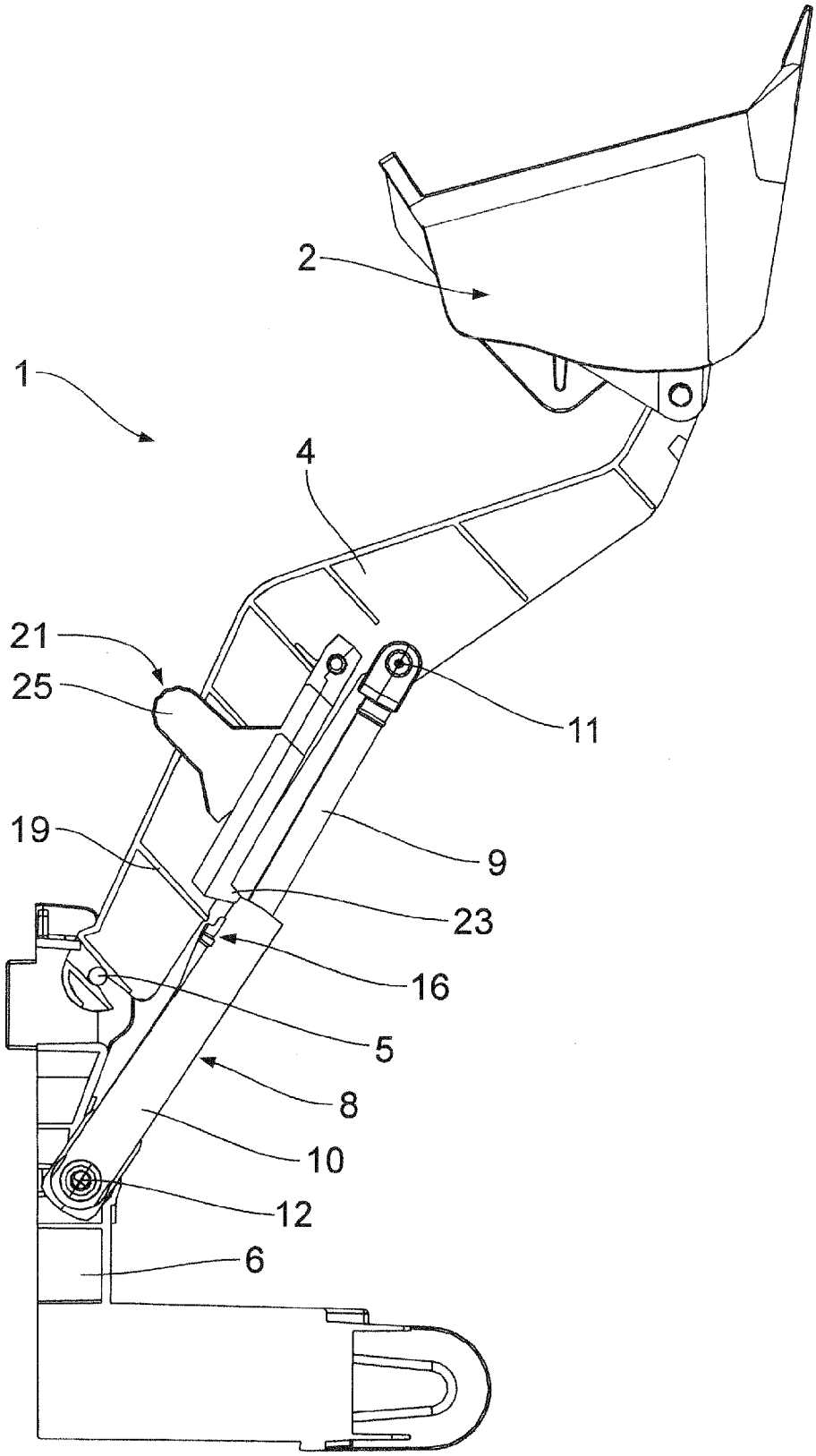
FIG. 8 is a view of the boom assembly similar to the view of FIG. 6, in an unlatching position.

Starting from the raised position according to FIG. 7, the detent of the latch mechanisms 15, 16 can be unlatched by means of the actuating elements 24, 25. This is shown in FIG. 8. In this respect, the impact bodies 23 are pressed against the ends of the telescopic sleeves 10 in the central regions of the telescopic supports 7, 8 in the extended state, by means of the actuating elements 24, 25. When the pressure is great enough, the telescopic supports 7, 8 are bent to such an extent that the counter bodies 18 are released from the latch seats 28 in the latch bodies 17, as shown in FIG. 8. Since the pressure on the actuating elements 24, 25 is directed downwards, this pressure simultaneously results in the bucket bearers 3, 4 being returned into the basic position.

Instead of two separate actuating elements 24, 25, in a variant (not shown) of the boom assembly it is also possible for a common actuating element to be provided, by which both impact bodies 23 can be actuated together.

What is claimed is:

1. A toy vehicle with a boom assembly (1) for a bucket (2), wherein the boom assembly (1) comprises at least one bucket bearer (3, 4) which is articulated to a frame (6) of the toy vehicle by a first swivel joint, at least one telescopic support (7, 8) with two telescopic elements (9, 10) which can be displaced in telescopic manner with respect to one another, one of the telescopic elements (9) being articulated to the bucket bearer (3, 4) by a second swivel joint, the other telescopic element (10) being articulated to the frame (6) by a third swivel joint, wherein at least one latch mechanism (15, 16) is provided, having a latch body (17) which is provided on one of the telescopic elements (10), having a counter body (18) which is provided on the bucket bearer (3, 4), wherein the bodies (17, 18) of the latch mechanism (15, 16) are positioned with respect to one another, such that when the bucket bearers (3, 4) are moved from a lowered basic position into a raised position, the latch body (17) comes to rest against the counter body (18) before the raised position is reached, the telescopic support (7, 8) being bent with the production of a bending tension, as the bucket bearers (3, 4) are moved further into the raised position, the latch body (17) latches with the counter body (18) so that the boom assembly (1) is fixed in the raised position, wherein the at least one telescopic support (7, 8) is a pretensioning element.

2. A toy vehicle according to claim 1, wherein the telescopic support (7, 8) and the bucket bearer (3, 4) are made of plastics material.

3. A toy vehicle according to claim 2, wherein at least one of the group of latch body (17) and counter body (18) are integrally formed parts of the telescopic support (7, 8) and the bucket bearer (3, 4).

4. A toy vehicle according to claim 1, wherein the unlatching lever (20, 21) is articulated to the bucket bearer (3, 4).

5. A toy vehicle according to claim 1, wherein the boom assembly (1) has pairs in each case of bucket bearers (3, 4), telescopic supports (7, 8) and latch mechanisms (15, 16).

6. A toy vehicle according to claim 5, wherein the boom assembly (1) has a pair of unlatching levers (20, 21) which is associated with the latch mechanisms (15, 16).

7. A toy vehicle according to claim 6, wherein the unlatching levers (20, 21) can be actuated by a common actuating element.

8. A toy vehicle with a boom assembly (1) for a bucket (2), wherein the boom assembly (1) comprises at least one bucket bearer (3, 4) which is articulated to a frame (6) of the toy vehicle by a first swivel joint, at least one telescopic support (7, 8) with two telescopic elements (9, 10) which can be displaced in telescopic manner with respect to one another, one of the telescopic elements (9) being articulated to the bucket bearer (3, 4) by a second swivel joint, the other telescopic element (10) being articulated to the frame (6) by a third swivel joint, wherein at least one latch mechanism (15, 16) is provided, having a latch body (17) which is provided on one of the telescopic elements (10), having a counter body (18) which is provided on the bucket bearer (3, 4), wherein the bodies (17, 18) of the latch mechanism (15, 16) are positioned with respect to one another, such that when the bucket bearers (3, 4) are moved from a lowered basic position into a raised position, the latch body (17) comes to rest against the counter body (18) before the raised position is reached, the telescopic support (7, 8) being bent with the production of a bending tension, as the bucket bearers (3, 4) are moved further into the raised position, the latch body (17) latches with the counter body (18) so that the boom assembly (1) is fixed in the raised position, wherein the toy vehicle further comprises at least one unlatching lever (20, 21) with an impact body (23) which can be changed over between a rest position in which the impact body (23) is at a distance from the telescopic support (7, 8), and an unlatching position in which the impact body (23) exerts pressure on the telescopic support (7, 8) such that the latch body (17) is released from the counter body (18), as the telescopic support (7, 8) is bent, for unlatching the raised position of the boom assembly (1).

9. A toy vehicle according to claim 8, wherein the latch body (17) is positioned in the central region of the fully extended telescopic support (7, 8).

* * * * *